US007152816B1

(12) United States Patent
Lawyer

(10) Patent No.: US 7,152,816 B1
(45) Date of Patent: Dec. 26, 2006

(54) MISTER NOZZLE APPARATUS

(75) Inventor: Jerry D. Lawyer, Clermont, FL (US)

(73) Assignee: Senninger Irrigation Inc., Clermont, FL (US)

( * ) Notice: Subject to any disclaimer, the term of this patent is extended or adjusted under 35 U.S.C. 154(b) by 0 days.

(21) Appl. No.: 11/174,250

(22) Filed: Jul. 5, 2005

(51) Int. Cl.
*B05B 1/30* (2006.01)

(52) U.S. Cl. ..... 239/570; 239/542; 239/547; 239/571; 239/600

(58) Field of Classification Search ..... 239/570, 239/394, 600, 571, 542, 547; 251/61.1
See application file for complete search history.

(56) References Cited

U.S. PATENT DOCUMENTS 4,660,598 A * 4/1987 Butterfield et al. ..... 137/510
4,882,189 A 11/1989 Corrigan
4,899,937 A * 2/1990 Haruch ..... 239/289
4,914,339 A 4/1990 Hayman, Jr. et al.
5,125,578 A * 6/1992 Ballu ..... 239/394
5,330,104 A 7/1994 Marcus
5,441,202 A 8/1995 Wintering et al.
5,711,482 A * 1/1998 Yu ..... 239/11
5,820,028 A * 10/1998 Dinur ..... 239/542
6,651,901 B1 11/2003 Jones

* cited by examiner

*Primary Examiner*—Dinh Q. Nguyen
(74) *Attorney, Agent, or Firm*—William M. Hobby, III

(57) ABSTRACT

A mister nozzle apparatus has a check valve incorporated therein to shut off the water passing through the misting nozzle to prevent draining of the water from the misting water supply pipes. The check valve has a resilient membrane valve element which opens and closes responsive to water pressure to block or open the nozzle inlet. The check valve is vented to atmosphere through a vent located in the housing between the resilient membrane and the nozzle misting outlet.

3 Claims, 2 Drawing Sheets

MISTER NOZZLE APPARATUS

BACKGROUND OF THE INVENTION

The present invention relates to a mister nozzle and especially to a mister nozzle having a check valve incorporated therein to shut off the water passing through the misting nozzle to prevent draining of the water from the mister water supply pipes.

In a typical nursery propagation house, mist nozzles are suspended above the plants on polymer tubing. Water is supplied to these nozzles through polymer tubes from an overhead system of pipes and valves. A valve must be positioned between each mister and the polymer tubing which is shut off to prevent the whole system from draining out through the nozzles when the water is turned off. When the water supply is turned on, pressure builds to a point overriding a check valve so that the valve opens. When the water supply is turned off, the pressure in the system drops so that the check valve is closed to prevent the water from draining out the mister nozzles. When the system pressure drops to a point equal to or less than the check valve seal force, the valve shuts and traps the remaining water in the system. Prior check valves have been separate products consisting of several parts. A check valve is vented through small vent holes that connect the vented side of the check valve seal to atmosphere through the side of the valve. The mister is a separate component having several parts which is attached to the bottom of a check or other valve hanging on the end of each polymer tube in the nursery propagation house.

Prior U.S. patents that involve water misting may be seen in the Corrigan U.S. Pat. No. 4,882,189 for a method of spraying water mist onto produce in a display case. Water is delivered to the nozzles by an upwardly extending supply pipe within the case, eliminating the need for an overhead mounting structure. The Hayman, Jr. et al. U.S. Pat. No. 4,914,339 is a misting system constructed of plastic pipe which is drilled and threaded to receive nozzle assemblies. Each nozzle has a valve that does not bleed to atmosphere so it requires another valve to lower the system pressure after the water supply is turned off. The Marcus U.S. Pat. No. 5,330,104 is a portable outdoor mister for providing a comfortable region within a relatively hot, dry environment and has a reservoir of water and a pump to supply the water for the spray. The Wintering et al. U.S. Pat. No. 5,441,202 is a misting system with improved couplers. This system has an automatic drain valve which includes a check valve operating in the reverse direction and can be positioned anywhere in the system by replacing a nozzle with the drain. The Jones U.S. Pat. No. 6,651,901 is a misting system nozzle holder with a manual slide shutoff valve. The misting system valve assembly is connected to a pressurized fluid supply.

The present invention advantageously combines a nursery mister with a check valve, eliminating a number of the components of a separate check valve and mister nozzle and, advantageously, vents the mister check valve to atmosphere downstream of the flow metering port and through the nozzle itself, allowing the incorporation of the check valve and a mister into one compact unit with the check valve located inside the mist nozzle housing downstream of the inlet port and upstream of the nozzle outlet.

SUMMARY OF THE INVENTION

A mister nozzle apparatus has a misting nozzle housing having a water inlet and an outlet therefrom. A swirl chamber in the housing is adjacent the outlet for creating a mist in the outlet. A check valve is located in the housing and has a seal support supporting a valve element, which may be a resilient membrane. The valve element has a closed position blocking the passage of water through the inlet until water in the inlet reaches a predetermined pressure and an open position which opens by moving the resilient membrane to open the passageway through the inlet into the swirl chamber upon water entering the inlet exceeding a predetermined pressure so that the mister nozzle shuts off the water passing therethrough to prevent draining of water from the water supply. The check valve is vented to atmosphere through a vent located in the housing between the resilient membrane and the swirl chamber. The inlet may have a raised lip to act as a valve seat for the resilient membrane. The resilient water sealing membrane is mounted in the housing and is compressed between a seal support on one side and the water inlet port on the other side. The resilient seal pressing against the inlet port opening prevents the system from draining out through the nozzle. The check valve is vented to atmosphere downstream of the flow metering port and through the nozzle itself which allows the incorporation of the check valve and the mister nozzle into one compact unit centrally located inside the mister nozzle housing and downstream of the inlet port and upstream of the nozzle outlet. This allows for a more compact mister and check valve.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
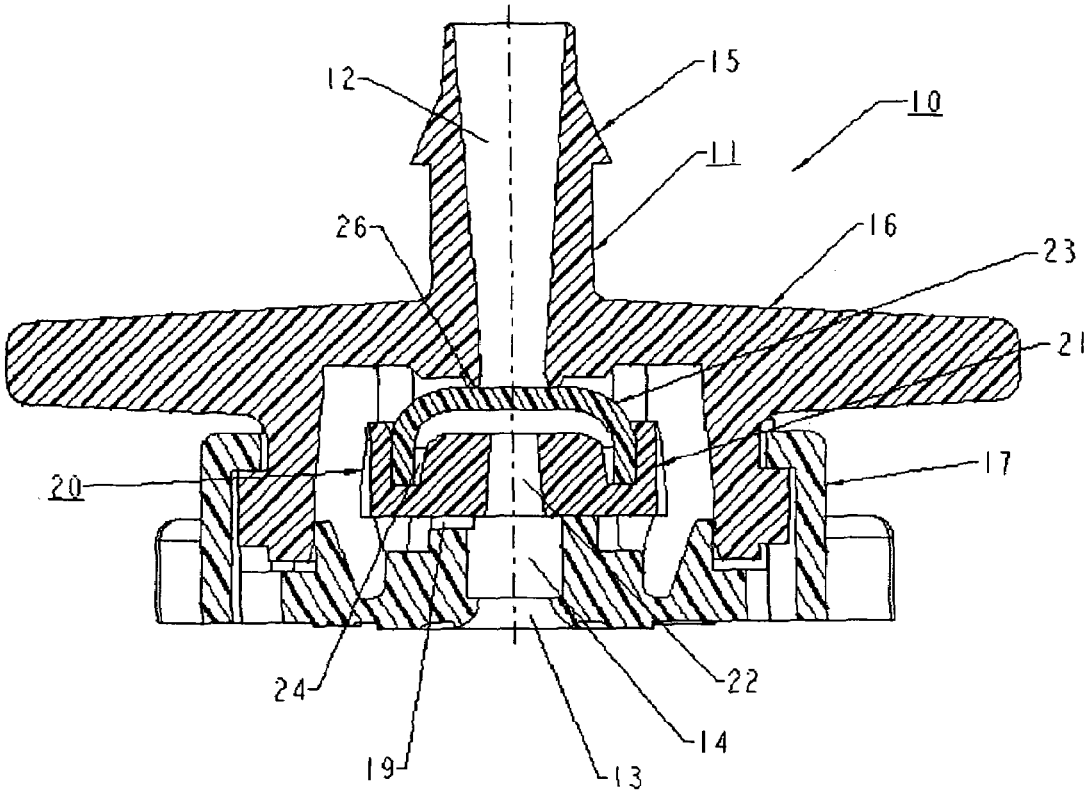
FIG. 1 is a sectional view of a mister nozzle in accordance with the present invention having the check valve in a closed position.

Referring to the drawings of FIGS. 1–4, a misting nozzle 10 is illustrated having a frame 11 and having an inlet 12 and an nozzle outlet 13. The misting nozzle 10 frame 11 includes a swirl chamber 14 formed therein adjacent the outlet 13. A housing 11 has a barbed portion 15 around the inlet 12 for attaching the misting nozzle 10 to tubing from a water supply. The housing 11 is formed of an upper housing 16 and a lower housing 17 which are connected together with cam lugs 18. A check valve 20 is mounted within the housing 11 between the upper housing 16 and a lower housing 17 and includes a seal or check valve support 21 having a check valve vent 22 extending therethrough to allow venting to the atmosphere through the swirl chamber 14 and nozzle outlet 13. A seal or valve support 20 has a valve element 23 in the nature of a seal made from a resilient membrane. The seal or valve support 21 has a grooved area 24 for holding the generally hemispherical shaped membrane 23. The lower housing 17 and the upper housing 16 attach together to hold the check valve 20 therebetween.

Figure 2:
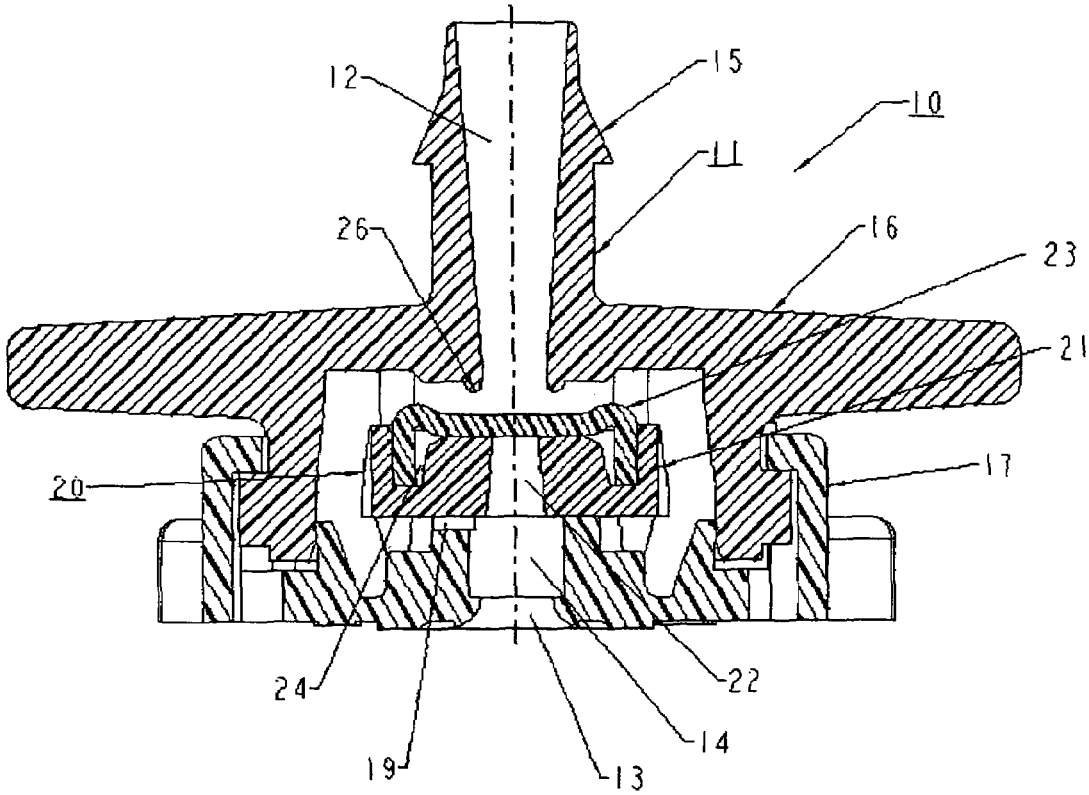
FIG. 2 is a sectional view of a mister nozzle in accordance with FIG. 1 having the check valve in an open position.
Figure 3:
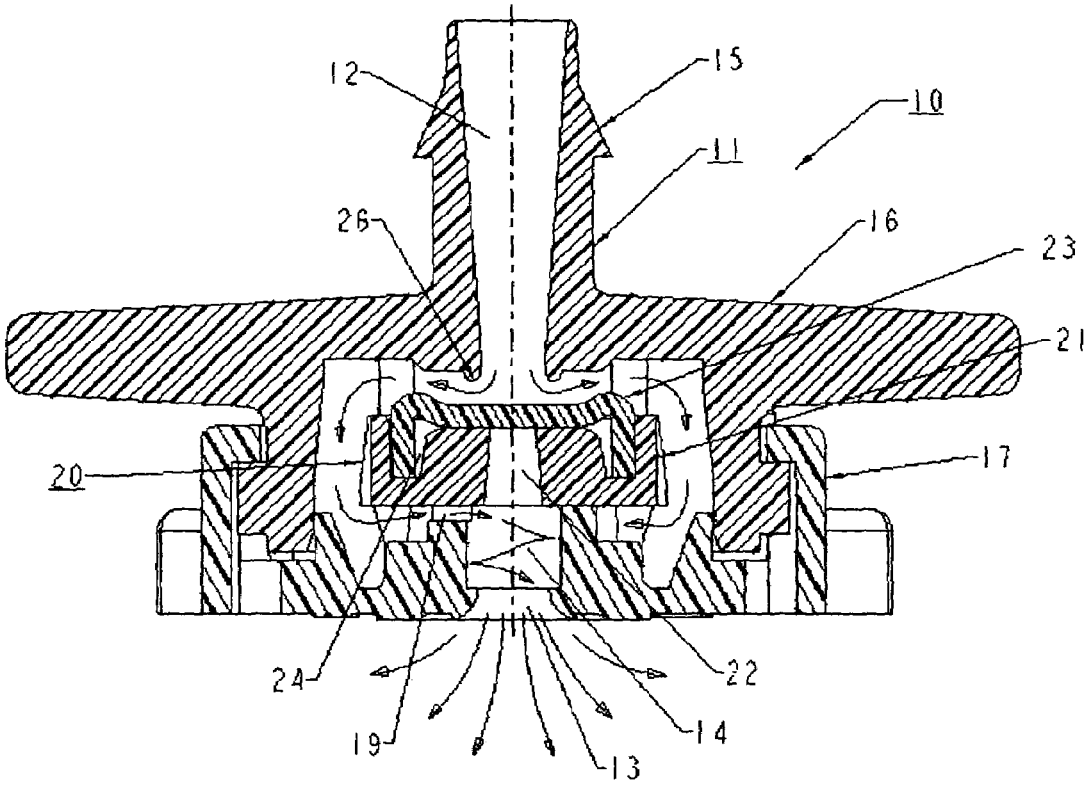
FIG. 3 is a sectional view of the check valve of FIGS. 1 and 2 illustrating the flow path of the water through the check valve in an open position.
Figure 4:
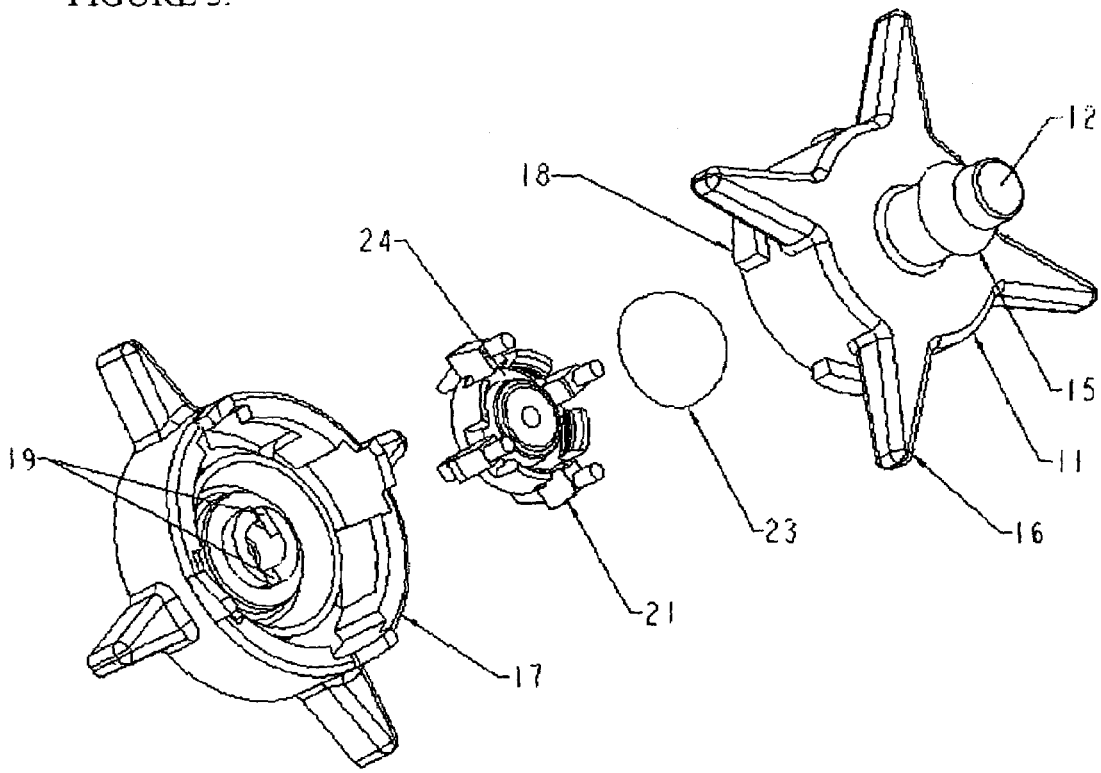
FIG. 4 is an exploded view of the mister nozzle in accordance with FIGS. 1–3.

The valve or seal support 21 with the resilient membrane seal 23 attached is pushed against a valve seat 26 which is a lip formed on the lower end of the inlet 12. In this manner, the inlet 12 is sealed by the sealing membrane 23 to prevent water in the inlet 12 from passing through the misting nozzle, as shown in FIG. 1. When the water in inlet 12 exceeds a predetermined pressure, the check seal 23 is forced away from the inlet, as shown in FIG. 2, to allow the passage of water therethrough, as shown in FIG. 3. As long as the water pressure is above a predetermined level in the inlet when the water in the system is turned on, the check valve 20 remains open, as seen in FIGS. 2 and 3. Once the water in the misting system is turned off, the water pressure in the inlet drops and the check seal or valve element 23 is released and pushes back to its closed position, as seen in FIG. 1, to prevent drainage of the misting system through the misting nozzle 10.

An important feature of the misting nozzle 10 is the check valve 20 which is vented to atmosphere through the check valve vent 22 and is vented downstream through the swirl chamber 14 and nozzle outlet 13 and allows the incorporation of the check valve and the mister nozzle into one compact unit. The check valve is simply located inside the mist nozzle housing 11 downstream of the inlet port 12 and upstream of the nozzle outlet 13. The vent 22 is provided to connect the vented side of the check valve seal or valve element 23 to the low pressure area provided by the swirl chamber 14 and nozzle outlet 13. Venting of the check valve is done downstream of the flow metering ports 19. This downstream low pressure position allows the check valve to respond rapidly to changing system pressures.

As seen in FIG. 3, the flow pattern through the valve, when the check valve is opened, is illustrated as the water passes through the inlet 12, as shown by the arrows, and around the valve element 23 through the metering ports 19 and into the swirl chamber 14 where it is discharged through the misting nozzle outlet 13. The check valve seal or valve element 23 is compressed between the seal support 21 on one side and the water inlet port 12 on the other side. The seal presses against the inlet port sealing bead or valve seat 26 and prevents the system from draining out through the nozzle.

It should be clear at this time that a nursery mister and check valve has been provided which combines a mister nozzle with a check valve to form a more compact combined unit with fewer parts than used in conventional mister nozzles and check valves. However, the present invention is not to be construed as limited to the forms shown which are to be considered illustrative rather than restrictive.

I claim:

1. A mister nozzle comprising:

a misting nozzle housing having an inlet and an outlet;

a swirl chamber in said housing adjacent said outlet for creating a mist in said outlet from water entering said swirl chamber;

a resilient water seal mounted in said housing blocking the passage of water though said inlet, said resilient water seal opening upon water in the inlet reaching a predetermined pressure to allow the passage of water from said inlet into said swirl chamber and out the outlet in a mist; and said housing having a vent located between said resilient water seal and said swirl chamber for venting one side of said resilient water seal to atmosphere through said swirl chamber and housing outlet;

whereby a misting nozzle is actuated by a predetermined water pressure in the inlet thereto and prevents water from draining from the water supply for the nozzle when the pressure drops below a predetermined level.

2. A misting nozzle in accordance with claim 1 having a seal support supporting said resilient water seal adjacent said inlet.

3. A misting nozzle in accordance with claim 2 in which said resilient water seal flexes upon a predetermined pressure being applying thereagainst.

* * * * *